United States Patent [19]

Ikeda et al.

[11] Patent Number: 4,707,415

[45] Date of Patent: Nov. 17, 1987

[54] STEEL STRIPS WITH CORROSION RESISTANT SURFACE LAYERS HAVING GOOD APPEARANCE

[75] Inventors: Satoshi Ikeda; Nobukazu Suzuki, both of Ibaraki, Japan

[73] Assignee: Sumitomo Metal Industries, Ltd., Osaka, Japan

[21] Appl. No.: 845,346

[22] Filed: Mar. 28, 1986

[30] Foreign Application Priority Data

Mar. 30, 1985 [JP] Japan ..... 60-065020
Mar. 30, 1985 [JP] Japan ..... 60-065021

[51] Int. Cl.[4] ..... B32B 15/04

[52] U.S. Cl. ..... 428/621; 428/624; 428/626; 428/628; 428/629; 428/632; 428/659

[58] Field of Search ..... 428/629, 632, 659, 626, 428/658, 621, 624, 628

[56] References Cited

U.S. PATENT DOCUMENTS 1,989,925 2/1935 Hoover et al. ..... 428/658
4,064,320 12/1977 Adaniya et al. ..... 428/632
4,202,921 5/1980 Enghag ..... 428/659
4,216,272 8/1980 Clauss ..... 428/632
4,252,866 2/1981 Matsudo et al. ..... 428/659
4,407,900 10/1983 Kirihara et al. ..... 428/659
4,450,209 5/1984 Hara et al. ..... 428/626
4,490,438 12/1984 Tsuda et al. ..... 428/613
4,519,878 5/1985 Hara et al. ..... 428/659

FOREIGN PATENT DOCUMENTS 43477 3/1985 Japan .

*Primary Examiner*—L. Dewayne Rutledge
*Assistant Examiner*—George Wyszomierski
*Attorney, Agent, or Firm*—Burns, Doane, Swecker & Mathis

[57] ABSTRACT

A surface-coated steel strip having improved corrosion resistance as well as a good surface appearance is disclosed. The steel strip comprises a zinc alloy layer plated on the steel strip, and a passive-state layer 0.005 to 1.0 μm thick which is applied on top of the plated zinc layer. A chromate film and/or an organic resin layer may be applied thereon.

23 Claims, 6 Drawing Figures

STEEL STRIPS WITH CORROSION RESISTANT SURFACE LAYERS HAVING GOOD APPEARANCE

BACKGROUND OF THE INVENTION

The present invention relates to surface-coated steel strips which can exhibit stable and uniform color tones as well as improved resistance to corrosion.

More particularly, the present invention relates to surface-coated steel strips especially suitable for use as painting-free steel strips, i.e. unpainted steel strips.

Recently, in the production of home electrical appliances, office automation equipment, automobiles and the like, there has been a tendency to reduce manufacturing costs by using unpainted steel materials. These steel materials in the form of steel strips, steel sheets, steel pipes, shaped steels, and the like must have better resistance to corrosion and a better surface appearance than conventional painted steel materials.

So far, several corrosion resistant steel materials have been proposed:

(1) Zn-alloy plated steel strips, e.g., Zn-Co, Zn-Ni, and Zn-Co-Cr alloy plated steel strips, or Zn-alloy+-chromate film-coated steel strips. Such materials are disclosed in Japanese patent application Laid-Open Specification No. 1986/1974.

(2) Zn-plated and chromate film-coated steel strips with an organic resin film or silicate film. Such materials are disclosed in Japanese patent application Laid-Open Specification No. 108292/1982.

Since these steel materials are grayish white or yellowish green in color, they have only limited use as unpainted steel strips due to their surface appearance.

Furthermore, it is known in the art that a Zn-alloy coating is effective to prevent the formation of red rust, but not to prevent white rust. In addition, when a chromate solution of the reaction type is applied to a Zn-alloy, the Cr deposit amounts to only a few milligrams per square meter. Such a small amount of a deposit is not effective to prevent white rust. In case of a chromate solution of the coating type, which is coated through roll coaters, spray nozzles, etc., it is possible to apply a large amount of Cr with an improvement in resistance to white rust. However, it is difficult to apply the coating uniformly, the surface appearance is not good enough to use without painting, and a problem of dissolution of free $Cr^{6+}$ ions is inevitable. This restricts application of chromate coated steel strips as painting-free steel strips.

On the other hand, there are also a number of steel materials which are known for having a good surface appearance. Examples of these materials are as follows:

(i) Pre-painted steel strips, or steel strips painted after formation.

(ii) Steel strips with a black resin film mainly containing carbon black. Such materials are disclosed in Japanese patent application Laid-Open Specification No. 62996/1981.

(iii) Black steel strips with a precious metal-containing chromate film.

(iv) Colored steel strips which are colored by dipping into a hydrochloride or molybdate solution.

(v) Electroplated steel strips using a Zn-plating bath containing Co ions, Ni ions, and other additives, the electroplated steel plates being subjected to an anodic treatment to color the strip surface. Such materials are disclosed in Japanese patent application Laid-Open Specification No. 151490/1983 and No. 151491/1983. More specifically, Japanese patent application Laid-Open Specification No. 151491/1983 discloses a steel strip which has an electroplated coating of a zinc alloy and an anodic treated layer. If necessary, an additional treatment such as a chromate treatment of the coating type and a resin coating treatment may be applied thereto.

However, all of the above materials suffer from various problems. Pre-painted steel strips are quite expensive and they cannot be welded. Black resin-coated steel strips exhibit poor resistance to white rust. Black chromate-coated steel strips have poor corrosion resistance, and as they contain a precious metal such as Ag, the material cost is inevitably high. In the case of colored steel strips which are colored using dipping bath, it is difficult to control the bath composition, and it takes a long time to obtain a stable surface appearance.

Steel strips which are subjected to electroplating and then to anodic treatment do not exhibit a deep color, and the surface appearance is often ununiform due to the influence of the flow rate of the electrolyte solution during plating and anodic treatment.

Furthermore, an anodized surface layer comprises oxides of metals such as Co, Ni, and Mo in the form of a porous film having pores on the order of an Angstrom. Therefore, it has poor resistance to white rust. Application of a silicate film has also been proposed, but steel strips with a silicate film do not have good resistance to white rust.

U.S. Pat. No. 4,548,868 discloses a surface coated steel strip comprising a steel strip, a zinc alloy layer electroplated on the strip, a chromate film formed on the zinc alloy layer, and a polyethylene coating cured to the chromate film. The chromate film is formed by so-called coating type method, and a substantial amount of free $Cr^{6+}$ ions inevitably remains in the film.

SUMMARY OF THE INVENTION

It is an object of the present invention to provide unpainted steel strips which exhibit a stable color tone and satisfactory corrosion resistance.

In summary, the present invention resides in a surface-coated steel strip having improved corrosion resistance as well as a good surface apprearance, comprising a steel strip, a zinc alloy layer preferably electroplated on the strip, and a passive-state layer of oxides or hydroxides or sulfides placed on the plated zinc layer.

The zinc alloy may be a Zn-Ni alloy of a single gamma-phase containing 10–20% by weight of Ni, which is electroplated on the steel strip in a weight of 1–50 $g/m^2$, preferably 5–30 $g/m^2$.

The passive-state layer comprises at least one of zinc oxide, zinc hydroxide, zinc sulfide, nickel oxide, nickel hydroxide, and nickel sulfide, and is 0.005–1.0 $\mu m$ thick, preferably 0.01–0.5 $\mu m$ thick.

In another aspect, the present invention resides in a surface-coated steel strip having improved corrosion resistance as well as a good surface appearance, comprising a steel strip, a zinc alloy layer preferably electroplated on the strip, a passive-state layer of oxides or hydroxides or sulfides placed on the plated zinc layer, and a chromate film formed on the passive-state layer in a weight of 10–300 $mg/m^2$ of chromium, preferably 15–200 $mg/m^2$ of chromium.

According to the present invention an organic resin coating 0.2–5.0 μm thick may be cured to the passive-state layer or to the chromate film.

In another preferred embodiment of the present invention, the zinc alloy which is applied to the steel strip may be selected from the group consisting of:

Zn-Ni alloys containing 10–20% by weight of Ni,
Zn-Co alloys containing 0.5–10% by weight of Co,
Zn-Mo alloys containing 0.5–10% by weight of Mo,
Zn-Fe alloys containing 10–30% by weight of Fe,
Zn-Ni-Co alloys containing 5–20% by weight of Ni+Co,
Zn-Ni-Mo alloys containing 5–20% by weight of Ni+Mo, and
Zn-Ni-Fe alloys containing 5–30% by weight of Ni+Fe.

An undercoating layer which comprises a zinc layer or zinc alloy layer or aluminum layer or aluminum layer in a weight of 5–150 g/m$^2$ may be provided on the steel strip. When the undercoating layer is provided, the amount of the above-mentioned overlying Zn-alloy may be up to 5 g/m$^2$.

In yet another preferred embodiment of the present invention, the chromate film is prepared by dipping the surface-coated steel strip with the electroplated and passive-state layers into a chromate solution of the reaction type to effect precipitation of chromic oxides or hydroxides or sulfides.

DETAILED DESCRIPTION OF THE PREFERRED EMBODIMENTS

A steel substrate which is employed in the present invention is not restricted to a particular one having specific dimensions. In general, a steel strip is advantageously used as a steel substrate for use in the present invention.

Figure 1:
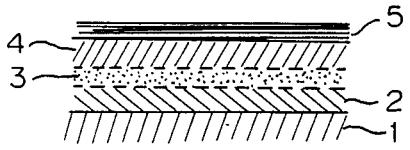
FIG. 1 is a schematic view of the section of a surface-coated steel strip of the present invention.

FIG. 1 shows a surface coated steel strip in section, in which a steel strip 1 which serves as a substrate is plated with an Zn-alloy layer 2. The surface-coated steel strip further includes a passive-state layer 3 comprising oxides or hydroxides or sulfides, which has been formed by means of anodic oxidation or chemical treatment.

To the passive-state layer 3 a chromate film 4 or an organic resin film 5 may be applied. The organic resin film 5 may also be applied to the chromate film 4.

An underlying layer (not shown) comprising a Zn or Zn-alloy plating or an Al or Al-alloy plating may be applied directly to the surface of the steel strip 1. When an underlying layer is provided, the coating thereon comprising the Zn-alloy may be up to 5 g/m$^2$ thick.

In a preferred embodiment, the first layer to be plated on the steel strip 1 comprises a single gamma-phase of a Zn-Ni alloy containing 10–20% by weight of Ni. The term "gamma-phase" used herein means an intermetallic compound given by the formulas $Ni_3Zn_{22}$, and/or $Ni_5Zn_{21}$, and/or $NiZn_3$. When the Ni content of the layer is less than 10% by weight, an $\eta$-phase appears, impairing the corrosion resistance. The formation of the $\eta$-phase is further undesirable because it prevents the formation of a uniform passive-state layer thereon. When the Ni content is higher than 20% by weight, a $\beta'$-phase comprising $Ni_xZn_y$ appears, hardening the plated layer, and powdering easily occurs. In addition, when the Ni content falls outside the range of 10–20% by weight, i.e., when the alloy is not of a single gamma-phase, a uniform passive-state layer cannot be formed.

Furthermore, when the weight of the plated layer is less than 1 g/m$^2$, the surface of the strip cannot be covered uniformly by the Zn-Ni alloy, and when it is over 50 g/m$^2$, the layer will easily peel off during press forming. Preferably, the weight is 5–30 g/m$^2$.

Under the above-mentioned plated Zn-alloy layer, a Zn plating layer including zinc and zinc alloy plating layer and an aluminum plating layer including aluminum and an aluminum alloy plating layer may be applied prior to the plating of the Zn-alloy. The under layer may be applied by means of an electroplating, dipping, or vacuum deposition process.

This undercoating layer is provided to further improve the resistance to red rust. The weight of the under layer is 5–150 g/m$^2$. When it is smaller than 5 g/m$^2$, its sacrificial effect in preventing corrosion is inadequate. A coating layer thicker than 150 g/m$^2$ is not desirable from the standpoint of economy.

When the undercoating mentioned above is provided, the weight of the overlying Zn-alloy may be not larger than 5 g/m$^2$, the Zn-alloy being selected from the group consisting of the following:

Zn-Ni alloys containing 10–20% by weight of Ni,
Zn-Co alloys containing 0.5–10% by weight of Co,
Zn-Mo alloys containing 0.5–10% by weight of Mo,
Zn-Fe alloys containing 10–30% by weight of Fe,
Zn-Ni-Co alloys containing 5–20% by weight of Ni+Co,
Zn-Ni-Mo alloys containing 5–20% by weight of Ni+Mo, and
Zn-Ni-Fe alloys containing 5–30% by weight of Ni+Fe.

Onto this plated layer, a passive-state layer 0.005–1.0 μm thick, preferably 0.01–0.5 μm thick is placed. The passive state layer comprises at least one of oxides, hydroxides, and sulfides of Zn and Ni, when the substrate is the Zn-Ni alloys.

In order to prepare the passive-state layer it is advisable to employ dipping into an oxidizing solution (e.g. nitric acid), anodic treatment, a treatment with an aqueous hydrogen sulfide, etc. Any suitable method may be used.

When the thickness of the passive-state layer is less than 0.005 μm, and sometimes less than 0.01 μm, it is impossible or difficult to uniformly cover the first layer. On the other hand, when the thickness is over 1.0 μm, and sometimes over 0.5 μm, the passive-state layer will easily peel off during press forming.

The provision of the first layer, i.e., the above-mentioned overlying Zn-alloy layer is essential to the present invention in order to provide the steel strip with resistance to red rust. The provision of the passive-state layer increases the resistance to red rust and simultaneously improves the surface appearance of the steel strip due to coloration which it causes. The passive-state layer turns black when NiO(OH), $Ni_2S$, NiS or Zn-oxides is included, and it turns blue when NiOH is included. Thus, by changing the composition of this layer, the surface appearance may be controlled. The composition does not affect the resistance thereof to red rusts, so long as the layer is formed uniformly.

However, though the passive-state layer can exhibit a markedly improved resistance to red rust, it is easily corroded by white rust under relatively severe corrosive conditions. It is supposed that the crystallized water (e.g., $2NiOOH = Ni_2O_3.H_2O$) incorporated therein has an adverse effect on the formation of white rust, although this has not been confirmed experimentally or explained theoretically.

Since one of the important features of the present invention is to obtain a good surface appearance, the formation of white rust is not desirable. Therefore, when an article to which the steel strip of the present invention is applied is used under severe corrosive conditions, a chromate film is preferably placed on the passive-state layer so as to further improve the resistance to white rust.

Furthermore, the passive-state layer shows interference colors which impair the surface appearance and sometimes are undersirable for certain applications. The chromate film placed thereon can advantageously eliminate such interference colors. The weight of the chromate film is 10–300 mg/m$^2$, and preferably 15–200 mg/m$^2$ of Cr. When it is less than 10 mg/m$^2$, it does not contribute to the prevention of white rust. On the other hand, when it is over 300 mg/m$^2$, the chromate film itself shows interference colors.

According to the findings of the inventors of the present invention, the chromate film can easily be formed on the passive-state layer.

Therefore, according to the present invention a chromate solution of the reaction type can be applied to give a relatively thick chromate film. As already mentioned, it has been thought that a chromate solution of the reaction type is not applicable to a Zn-alloy coating, since only a very thin chromate film is formed.

The reasons why a relatively thick layer of a chromate film of the reaction type can be obtained on the passive-state layer are that the passive-state layer is rather fine and porous, and a chromate solution easily reacts with such a porous film because each pore acts as an active reaction site.

The resulting chromate film comprises oxides, hydroxides, or sulfides of the alloying element or elements of the underlying layer of a Zn-alloy.

When steel strips are used without being painted, a patern is frequently directly applied to the strips by silk screen printing. However, when the surface of a strip is covered with oxides, hydroxides, or sulfides, some types of printing inks do not adhere at all. Therefore, the presence of the passive-state layer or the chromate layer makes it difficult to perform silk screen printing.

For this reason, an uppermost layer of a resin 0.2–5.0 μm thick may be placed on the passive-state layer or on the chromate layer to make it easier to perform silk screen printing. The resin layer is also effective to improve the corrosion resistance of the undercoatings and finger print resistance. For these purposes an organic resin such as transparent or translucent acrylic resins, epoxy resins, alkyd resins, polyvinyl alcohol resins, phenolic resins, or polyester resins may advantageously be applied in the form of a thin film.

When the thickness of the resin layer is less than 0.2 μm, the ease of performing silk screen printing is not improved and the resistance to finger prints is poor. In addition, the resin layer itself gives interference colors. On the other hand, when the thickness is over 5.0 μm, welding is impossible and the material cost increases.

Thus, the provision of the resin layer further improves the resistance to white rust and can eliminate interference colors. In addition, the variability in surface color, which is caused by a fluctuation in processing conditions, is markedly reduced.

The present invention will be further described in conjunction with some working examples, which are presented merely for illustrative purposes and in no way restrict the present invention.

EXAMPLE 1

A Zn-Ni alloy comprising a single gamma-phase was applied to a steel strip by electroplating, and a passive-state layer was formed thereon by means of an anodic oxidation to prepare a variety of samples. The first layer, i.e., the underlying layer weighed from 0.8 g/m$^2$ to 55 g/m$^2$. The thickness of the first layer, the appearance of the steel strip, and the adhesive strength of the first layer after drawing were determined.

The test results are summarized in Table 1.

The adhesive strength was determined by using adhesive tape after cup-drawing with a drawing ratio of 2.

As is apparent from the data shown in Table 1, there is unevenness in appearance and peeling of the coating after drawing is marked when the coating weight of the first layer falls outside the range of 1–50 g/m$^2$. However, the steel strip prepared in accordance with the present invention can exhibit a satisfactory surface appearance and corrosion resistance or adhesion.

EXAMPLE 2

A Zn-Ni alloy layer was applied to a steel strip by electroplating and then a passive-state layer was formed thereon. The passive-state layer was formed by means of anodic oxidation carried out in a solution containing 20 g/l of $NaNO_3$, 100 g/l of $Na_2SO_4$, and 3 g/l of $NaNO_2$ with a pH of 10 at a temperature of 50° C.

A corrosion test (SST JIS Z 2371) was carried out for each of Samples Nos. 1–7.

The test results are summarized in Table 2.

Samples Nos. 2–4 which were prepared in accordance with the present invention exhibited not only a uniform black color but also improved corrosion resistance. However, the other samples exhibited poor color and corrosion resistance.

EXAMPLE 3

A Zn-Ni alloy (Zn 88 wt %, Ni 12 wt %) was applied to a steel strip by electroplating in a weight of 20 g/m$^2$. A passive-state layer varying in thickness was applied to the surface area of the alloy deposit by means of etching with a nitric acid solution. A corrosion test (SST JIS Z 2371) was carried out for each of the test pieces.

Figure 2:
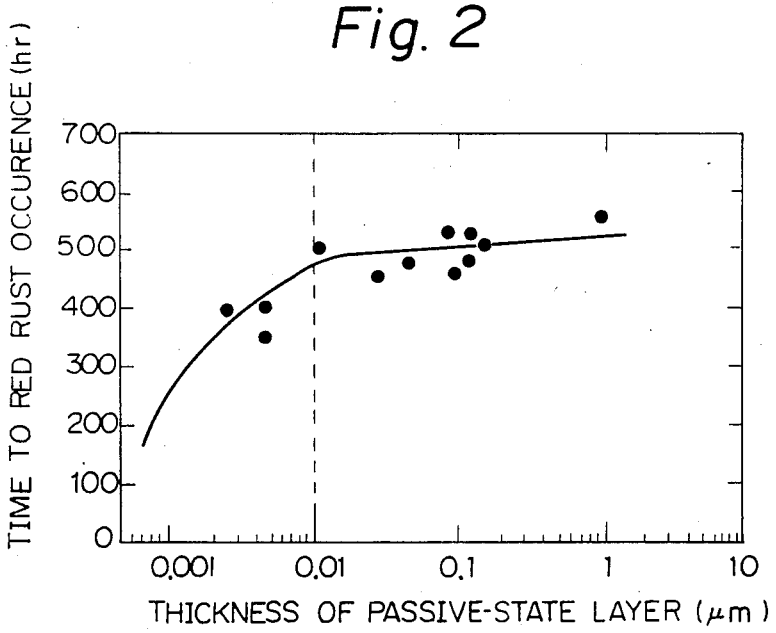
FIGS. 2–6 are graphs showing test results of working examples of the present invention.

The test results are shown in the form of a graph in FIG. 2.

As is apparent from FIG. 2, when the passive-state layer was 0.005–1.0 μm, preferably 0.01–0.5 μm thick, a satisfactory level of corrosion resistance was obtained.

EXAMPLE 4

A Zn-Ni alloy comprising a single gamma-phase (Zn 87 wt %, Ni 13 wt %) was applied to a steel strip by electroplating in a weight of 20 g/m$^2$, and a passive-state layer was formed thereon by means of an anodic oxidation to prepare a variety of samples with different compositions and thicknesses. The corrosion resistance of the samples after working was determined in accordance with the same corrosion test (SST JIS Z 2371) as for the previous examples.

The test results are summarized in Table 3.

As is apparent from the data shown in Table 3, the steel strips prepared in accordance with the present invention exhibited a satisfactory surface appearance and corrosion resistance.

EXAMPLE 5

A steel strip was electroplated with a Zn-Ni alloy of a single gamma-phase containing 88 wt % of Zn and 12 wt % of Ni in a weight of 20 g/m$^2$.

On the electroplated layer, a passive-state layer in a thickness of 0.06 μm was formed as shown in Example 2. Next, a chromate film was applied in various thicknesses to prepare a lot of test samples. The same corrosion test (SST JIS Z 2371) as in the previous examples was applied to each of these test pieces.

The corrosion resistance was determined based on the time period which elapsed until white rust was formed.

Figure 3:
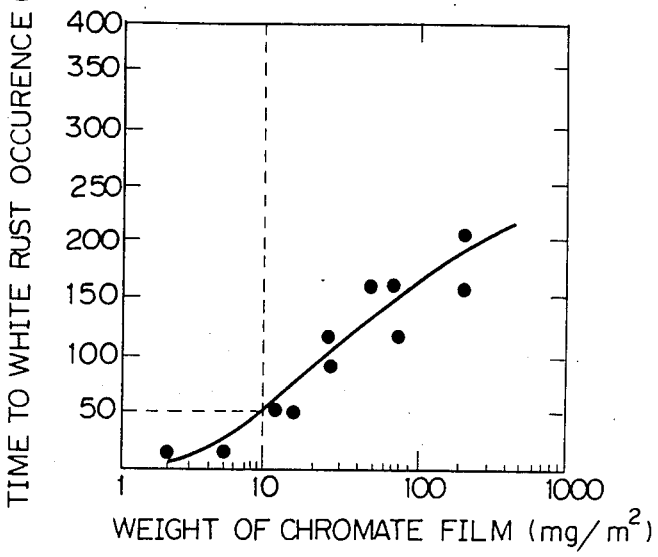

The test results are summarized in FIG. 3.

As is apparent from FIG. 3, when the chromate film was deposited in a weight of Cr of 10–300 mg/m$^2$, the resistance to white rust was satisfactory.

EXAMPLE 6

A steel strip was electroplated with a Zn-Ni alloy of a single gamma-phase containing 82 wt % of Zn and 18 wt % of Ni in a weight of 20 g/m$^2$.

On the electroplated layer, a passive state layer in a thickness of 0.04 μm was formed as shown in Example 2. Then, a chromate film was applied thereto in varied amounts to prepare a lot of test samples. The appearance and interference colors were examined for each of these test samples.

The test results are summarized in Table 4.

As is apparent from Table 4, when the chromate film was deposited in a weight of Cr of 10–300 mg/m$^2$, the surface appearance was satisfactory and there was less interference color.

EXAMPLE 7

A steel strip was electroplated with a Zn-Ni alloy of a single gamma-phase containing 87 wt % of Zn and 13 wt % of Ni in a weight of 20 g/m$^2$.

On the electroplated layer, a passive state layer in a thickness of 0.07 μm was formed by means of an anodic oxidation. Then, a chromate film as well as a resin layer were applied thereto in varied amounts to prepare a lot of test samples. The ability to perform silk screen printing thereon was examined for each of these test samples. On each of the samples silk screen printing was performed such that the thickness of the ink was 10 μm±2 μm and the film was scratched in intervals of 10 mm to provide 100 squares. Adhesive tape was applied thereto and then peeled off. The remaining squares of ink were measured.

The test results are summarized in Table 5.

As is apparent from Table 5, when the chromate film as well as the resin film were deposited in accordance with the present invention, it was possible to perform silk screen printing in a satisfactory manner.

EXAMPLE 8

A steel strip was electroplated with a Zn-Ni alloy of a single gamma-phase containing 86 wt % of Zn and 14 wt % of Ni in a weight of 15 g/m$^2$.

On the electroplated layer, a passive-state layer in a thickness of 0.01–1.0 μm was formed by means of an anodic oxidation, the passive-state layer comprising 42% by weight NiO(OH), 9% by weight $Ni(OH)_2$ and 49% by weight $Zn(OH)_2$. Then, an epoxy-modified acrylic resin was applied thereto in a thickness of 2 μm to prepare a lot of test samples.

A color-difference meter was used to determine the values of L*, a*, and b* for each of these test samples.

Figure 4:
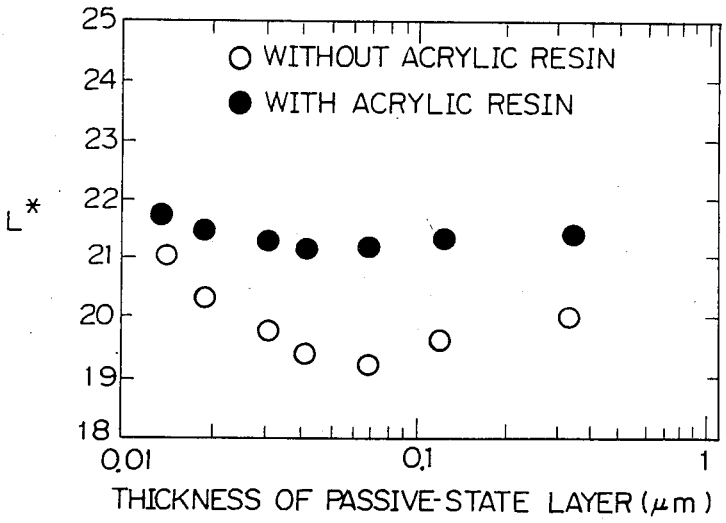
Figure 5:
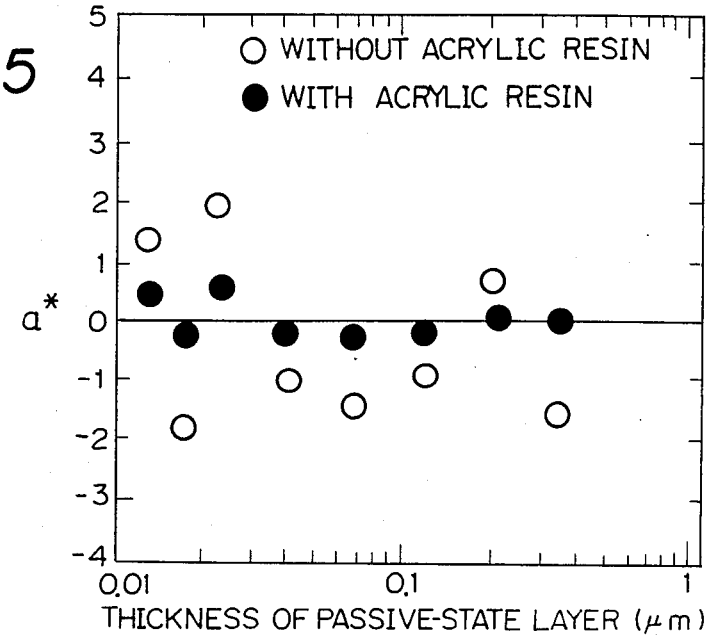
Figure 6:
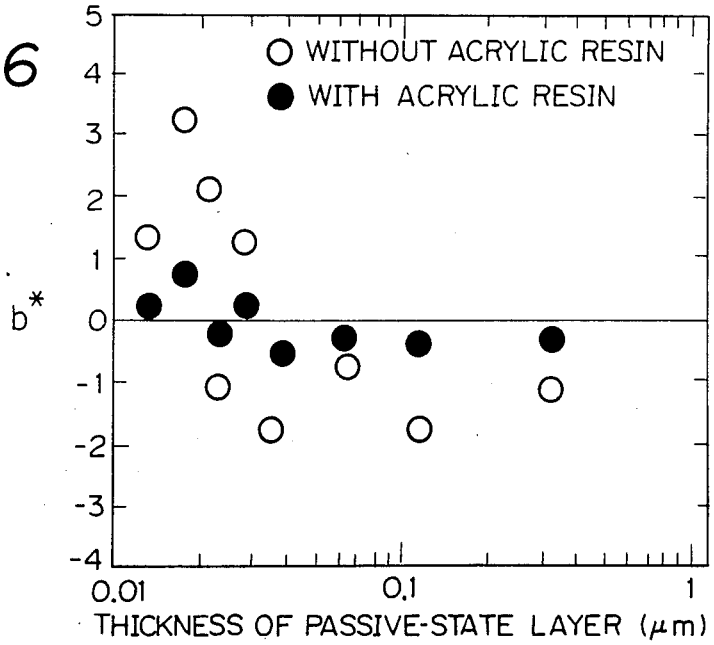

The test results are summarized in FIGS. 4–6.

As is apparent from FIGS. 4–6, when the organic resin film was applied, the color tone of the resultant surface-coated steel strip was stable regardless of the thickness of the passive-state layer.

EXAMPLE 9

A steel strip was electroplated with a zinc layer. On top of this zinc layer, a Ni-Zn alloy containing 12% by weight of Ni was applied in a weight of 2 g/m$^2$ by electroplating.

The resulting surface-coated steel strip was dipped into a 10% $HNO_3$ solution to provide a passive-state layer 0.05 μm thick.

The resulting samples were then subjected to a chromate treatment using a chromate solution containing 15 g/l of $CrO_3$, 3 g/l of $HNO_3$ and 1 g/l of HF at a pH of 2. The chromate solution at 50° C. was sprayed onto these samples to provide a chromate film in a thickness of 100 mg/m$^2$. The upper surface of the passive-state layer comprising oxides, hydroxides, or sulfides of a Ni-Zn compound was changed into one containing Cr by the sprayed application of the chromate solution.

The formation of a passive-state layer was confirmed by measuring the electrode potential when it was dipped in a 50 g/l $Na_2SO_4$ solution at room temperature.

The same salt spray test as in the previous examples was carried out at 50° C. to determine a period of time to red rust occurrence in respect to a thickness of the under layer.

The test results are summarized in Table 6.

EXAMPLE 10

A steel strip was electroplated using a plating solution containing 140 g/l of $ZnSO_4.7H_2O$, 250 g/l of $NiSO_4.6H_2O$, and 50 g/l of $Na_2SO_4$ at a pH of 2 at 50° C. The electroplated layer of Ni-Zn alloy containing 13% by weight of Ni in a weight of 23–30 g/m$^2$ was placed on the steel strip for the purpose of improving the corrosion resistance due to the alloy's sacrificial corrosion resistant properties as well as for the purpose of preparing the layer for anodizing.

The resulting steel strips were further subjected to an anodic treatment in a solution containing 50 g/l of $Na_2SO_4$ and 50 g/l of $Ca(NO_3)$ at a pH of 8.0 at 50° C. The strength of the electrical current was varied to change the thickness of the resulting anodized film. On this anodized film the chromate treatment shown in Example 9 was applied.

The salt spray test and the humidity ageing test were carried out at 50° C. and a relative humidity of 95% for each of the samples, which comprised a flat and smooth portion and a crosscut portion.

The test results are summarized in Table 7.

The thickness of the anodized layer depends on the current density supplied during the anodic treatment.

On Sample No. 8, a water-based acrylic resin coating (Voncoat AW-7539, trade name of DAINIPPON INK AND CHEMICAL INC.) was applied in a thickness of 0.5 μm.

The surface appearance of each of the samples is also given in Table 7.

As is apparent therefrom, according to the present invention a uniform black color and an attractive surface appearance were obtained. In particular, Sample No. 8 which had a water-based acrylic resin coating thereon exhibited not only improved resistance to red rust and white rust, but also a good appearance.

EXAMPLE 11

A steel strip was electroplated with a Zn alloy using the three types of plating solutions shown in Table 8.

TABLE 1-continued

| First layer | g/m$^2$ | Passive-state layer | Appearance | Adhesion* |
|---|---|---|---|---|
| Single $\gamma$ phase | 8 | $Ni(OH)_2$ 4% | ○ (Good) | ○ |
| | 22 | $Zn(OH)_2$ 32% | ○* (Good) | ○ |
| | 48 | 0.14 μm Thick | ○ (Good) | ○ |
| | 55 | | ○ (Good) | X |

Note:
*Adhesion of passive-state layer after drawing
◎: No peeling-off
○: Substantially no peeling-off
X: Much peeling-off

TABLE 2

| Sample No. | First layer Zn [wt %] | Ni [wt %] | Weight [g/m$^2$] | Phase | Passive-state layer Appearance | Thickness [μm] | Time to red rust occurrence [hr] |
|---|---|---|---|---|---|---|---|
| 1 | 92 | 8 | 20 | $\eta + \gamma$ | Very uneven | 0.02 | 180 |
| 2 | 90 | 10 | 20 | $\gamma$ | Uniform black | 0.12 | 520 |
| 3 | 85 | 15 | 20 | $\gamma$ | Uniform black | 0.08 | 530 |
| 4 | 80 | 20 | 20 | $\gamma$ | Uniform black | 0.04 | 480 |
| 5 | 75 | 25 | 20 | $\gamma + \beta$ | Uneven | 0.10 | 260 |
| 6 | 90 | 10 | 0.5 | $\gamma$ | Very uneven | 0.002 | 10 |
| 7 | 88 | 12 | 20 | $\gamma$ | — | — | 290 |

The resulting Zn alloy-coated steel strip was treated as shown in Example 10 to provide a passive-state layer including a chromate film thereon.

The same corrosion test as for the previous examples was carried out for each of the resulting samples and the surface appearance thereof was examined.

The test results are summarized in Table 9.

On the resulting surface coated steel strips, a water-based acrylic resin coating (PN4523, a trade name of NIHON PARKERIZING Co., Ltd.) was applied in a thickness of 0.4 μm, the samples were subjected to the same corrosion test as in the previous examples and the surface appearance thereof was examined.

The test results are summarized in Table 10.

As is apparent from Table 10, the samples to which was applied the organic resin film in a thickness of 0.4 μm exhibited improved resistance to corrosion, did not exhibit any interference colors of the passive-state layer, and had a good surface appearance.

Although the present invention has been described with respect to preferred embodiments, it is to be understood that variations and modifications may be employed without departing from the concept of the invention as defined in the following claims.

TABLE 1

| First layer | g/m$^2$ | Passive-state layer | Appearance | Adhesion* |
|---|---|---|---|---|
| Zn 81% | 0.8 | $Ni_2O_3$ 61% | X (Uneven) | ◎ |
| Ni 19% | 1.2 | NiO 3% | ○ (Good) | ◎ |
| Single $\gamma$ phase | 8 | $Ni(OH)_2$ 5% | ○ (Good) | ◎ |
| | 22 | $Zn(OH)_2$ 31% | ○ (Good) | ◎ |
| | 48 | 0.15 μm Thick | ○ (Good) | ○ |
| | 55 | | ○ (Good) | X |
| Zn 88% | 0.8 | $Ni_2O_3$ 60% | X (Uneven) | ◎ |
| Ni 12% | 1.2 | NiO 4% | ○ (Good) | ◎ |

TABLE 3

| First layer | Passive-state layer | Appearance | Time to red rust occurrence [hr] |
|---|---|---|---|
| Zn 87% | NiO(OH) 37% | Black | 500 |
| Ni 13% | $Ni(OH)_2$ 5% | | |
| Weight 20 g/m$^2$ | $Zn(OH)_2$ 58% | | |
| Single $\gamma$ phase | 0.14 μm Thick | | |
| | NiOH 41% | Dark blue | 490 |
| | $Ni(OH)_2$ 7% | | |
| | $Zn(OH)_2$ 52% | | |
| | 0.11 μm Thick | | |
| | $Ni_2S$ 46% | Black | 470 |
| | $Ni(OH)_2$ 12% | | |
| | $Zn(OH)_2$ 42% | | |
| | 0.09 μm Thick | | |
| | NiO 4% | Black | 530 |
| | $Ni_3O_4$ 2% | | |
| | $Ni_2O_3$ 29% | | |
| | ZnO 65% | | |
| | 0.18 μm Thick | | |

TABLE 4

| First layer | Passive-state layer [μm] | Chromate film [mg/m$^2$ as Cr] | Appearance* |
|---|---|---|---|
| Zn 82% | 0 | 0 | X |
| Ni 18% | 0.04 | 12 | ○ |
| Weight 20 g/m$^2$ | 0.04 | 126 | ○ |
| Single $\gamma$ phase | 0.04 | 213 | ○ |
| | 0.04 | 280 | ○ |
| | 0.04 | 330 | Δ |

Note:
*○: Less interference color
Δ: Fair
X: Much interference color

TABLE 5

| Sample | | | | |
|---|---|---|---|---|
| First layer | Passive-state layer | Chromate film [mg/m$^2$ as Cr] | Organic resin film [μm] | Remaining squares [%] |
| Zn 87% | 0.07 μm | — | — | 25 |
| Ni 13% | | 76 | — | 32 |
| Weight 20 g/m$^2$ | | — | Epoxy-modified acrylic resin 0.1 | 58 |
| Single γ phase | | — | Epoxy-modified acrylic resin 0.2 | 98 |
| | | — | Epoxy-modified acrylic resin 3.8 | 100 |
| | | — | Epoxy-modified acrylic resin 4.9 | 100 |
| | | 76 | Epoxy-modified acrylic resin 0.1 | 54 |
| | | 76 | Epoxy-modified acrylic resin 0.2 | 100 |
| | | 76 | Epoxy-modified acrylic resin 4.9 | 100 |
| | | — | Unsaturated polyester resin 0.3 | 100 |
| | | — | Unsaturated polyester resin 4.5 | 100 |
| | | — | Unsaturated polyester resin 0.1 | 53 |
| | | 76 | Unsaturated polyester resin 0.1 | 48 |
| | | 76 | Unsaturated polyester resin 0.3 | 100 |
| | | 76 | Unsaturated polyester resin 4.7 | 100 |
| | | — | Epoxy resin 0.1 | 61 |
| | | — | Epoxy resin 0.4 | 100 |
| | | — | Epoxy resin 4.5 | 100 |
| | | 76 | Epoxy resin 0.1 | 59 |
| | | 76 | Epoxy resin 0.4 | 100 |
| | | 76 | Epoxy resin 4.5 | 100 |

TABLE 6

| Under layer [g/m$^2$] | Zn—Ni alloy layer [g/m$^2$] | Passive-state layer [μm] | Chromate film [mg/m$^2$ as Cr] | Time to red rust occurrence [hr] |
|---|---|---|---|---|
| — | 2 | 0.05 | 100 | 160 |
| 2 | 2 | 0.05 | 100 | 160 |
| 6 | 2 | 0.05 | 100 | 170 |

TABLE 6-continued

| Under layer [g/m$^2$] | Zn—Ni alloy layer [g/m$^2$] | Passive-state layer [μm] | Chromate film [mg/m$^2$ as Cr] | Time to red rust occurrence [hr] |
|---|---|---|---|---|
| 50 | 2 | 0.05 | 100 | 220 |
| 100 | 2 | 0.05 | 100 | 270 |
| 150 | 2 | 0.05 | 100 | 320 |

TABLE 7

| No. | Weight of Ni—Zn underlying layer [g/m$^2$] | Thickness of passive-state layer [μm] | Amount of chromate film [mg/m$^2$ as Cr] | Appearance after 1000 hrs of SST: Flat portion | Appearance after 1000 hrs of SST: Crosscut portion | Appearance after 2000 hrs of humidity aging test: Flat portion | Appearance after 2000 hrs of humidity aging test: Crosscut portion | Appearance |
|---|---|---|---|---|---|---|---|---|
| 1 | 30 | — | — | ★ | ★ | Δ | X | ○ Metallic luster |
| 2 | 29 | 0.008 | 5 | X | ★ | Δ | X | X Dark grey |
| 3 | 28 | 0.02 | 50 | ○ | Δ | ○ | ○ | ○ Black |
| 4 | 27 | 0.15 | 80 | ○ | Δ | ○ | ○ | ○ Black |
| 5 | 26 | 0.30 | 150 | ○ | Δ | ○ | ○ | ○ Black |
| 6 | 25 | 0.50 | 200 | ○ | Δ | ○ | ○ | ○ Black |
| 7 | 23 | 0.9 | 250 | ○ | X | ○ | ○ | Δ Black |

TABLE 7-continued

| No. | Weight of Ni—Zn underlying layer [g/m²] | Thickness of passive-state layer [μm] | Amount of chromate film [mg/m² as Cr] | Appearance after 1000 hrs of SST | | Appearance after 2000 hrs of humidity aging test | | Appearance |
|---|---|---|---|---|---|---|---|---|
| | | | | Flat portion | Crosscut portion | Flat portion | Crosscut portion | |
| 8 | 25 | 0.3 | 190 | ◎ | ◎ | ◎ | ◎ | ◎ | Black |

Evaluation of corrosion resistance
: Red rust over entire surface
X: Red rust in portions
Δ: White rust over entire surface
O: White rust in portions
◎: No white rust
Evaluation of appearance
◎: Excellent
O: Good
Δ: Somewhat ununiform
X: Ununiform

TABLE 8

| Plating Solution | Plated Film |
|---|---|
| Plating solution-I | |
| $ZnSO_4.7H_2O$ 140 g/l<br>$CoSO_4.7H_2O$ 50 g/l<br>$Na_2SO_4$ 50 g/l<br>pH = 1.6, 55° C. | Zn—5% Co<br>Weight 20 g/m² |
| Plating solution-II | |
| $ZnSO_4.7H_2O$ 150 g/l<br>$(NH_4)_6Mo_7O_{24}.4H_2O$ 20 g/l<br>$(NH_4)_2SO_4$ 30 g/l<br>pH = 2.0, 50° C. | Zn—2% Mo<br>Weight 20 g/m² |
| Plating solution-III | |
| $ZnSO_4.7H_2O$ 150 g/l<br>$FeSO_4.7H_2O$ 130 g/l<br>$Na_2SO_4$ 50 g/l<br>pH = 1.8, 50° C. | Zn—13% Fe<br>Weight 20 g/m² |

2. A surface-coated steel strip as defined in claim 1, in which the Zn alloy is electroplated on the steel strip.

3. A surface coated steel strip as defined in claim 1, in which the thickness of the passive state layer is 0.01–0.5 μm.

4. A surface-coated steel strip as defined in claim 1, in which an organic resin layer is applied on top of the passivestate layer.

5. A surface-coated steel strip having improved corrosion resistance as well as a good surface appearance, comprising a steep strip, a zinc alloy layer plated on the steel strip, and a passive-state layer of oxides or hydroxides or sulfides from 0.005 to 1.0 μm thick which is applied on top of the plated zinc layer in which the Zn alloy applied on top of the plated zinc layer in which the Zn alloy applied to the steel strip is selected from the group consisting of:

TABLE 9

| No. | Weight of undelying plating [g/m²] | Thickness of passive-state layer [μm] | Amount of chromate film [mg/m² as Cr] | Appearance after 1000 hrs of SST | | Appearance after 2000 hrs of humidity aging test | | Appearance |
|---|---|---|---|---|---|---|---|---|
| | | | | Flat portion | Crosscut portion | Flat portion | Crosscut portion | |
| 1 | 17 | 0.2 | 80 | O | Δ | O | O | O | Black |
| 2 | 16 | 0.3 | 90 | O | Δ | O | O | O | Black |
| 3 | 17 | 0.2 | 60 | O | Δ | O | O | O | Black |

TABLE 10

| No. | Weight of undelying plating [g/m²] | Thickness of passive-state layer [μm] | Amount of chromate film [mg/m² as Cr] | Appearance after 1000 hrs of SST | | Appearance after 2000 hrs of humidity aging test | | Appearance |
|---|---|---|---|---|---|---|---|---|
| | | | | Flat portion | Crosscut portion | Flat portion | Crosscut portion | |
| 1' | 17 | 0.2 | 80 | ◎ | O | ◎ | O | ◎ | Black |
| 2' | 16 | 0.3 | 90 | ◎ | O | ◎ | O | ◎ | Black |
| 3' | 17 | 0.2 | 60 | ◎ | O | ◎ | O | ◎ | Black |

Evaluation of corrosion resistance
Δ: White rust over entire surface
O: White rust in portions
◎: No white rust
Evaluation of appearance
◎: Excellent
O: Good
Δ: Somewhat ununiform
X: Ununiform

What is claimed:

1. A surface-coated steel strip having improved corrosion resistance as well as a good surface appearance, comprising a steel strip, a zinc alloy layer plated on the steel strip, and a passive-state layer of oxides or hydroxides or sulfides of the alloying element or elements of said zinc alloy from 0.005 to 1.0 μm thick which is applied on top of the plated zinc layer.

Zn-Ni alloy containing 10–20% by weight of Ni,
Zn-Co alloys containing 0.5–10% by weight of Co,
Zn-Mo alloys containing 0.5–10% by weight of Mo,
Zn-Fe alloys containing 10–30% by weight of Fe,
Zn-Ni-Co alloys containing 5–20% by weight of Ni+Co,
Zn-Ni-Mo alloys containing 5–20% by weight of Ni+Mo, and Zn-Ni-Fe alloys containing 5–30% by weight of Ni+Fe.

6. A surface-coated steel strip as defined in claim 5, in which an underlying layer of Zn or Zn-alloy plating or Al or Al-alloy plating is provided as a sacrificial corrosion-resistant layer in a weight of 5–150 g/m$^2$, and the weight of the overlying Zn-alloy layer is not larger than 5 g/m$^2$.

7. A surface-coated steel strip having improved corrosion resistance as well as a good surface appearance, comprising a steel strip, a zinc alloy layer plated on the steel strip, a passive-state layer of oxides or hydroxides or sulfides from 0.005 to 1.0 μm thick applied on top of the plated zinc layer, and a chromate layer formed on the passive-state layer.

8. A surface-coated steel strip as defined in claim 7, in which the chromate layer is formed on the passive-state layer using a chromate solution of the reaction type.

9. A surface-coated steel strip as defined in claim 7, in which the Zn alloy is electroplated on the steel strip.

10. A surface-coated steel strip as defined in claim 7, in which the thickness of the passive-state layer is 0.01–0.5 μm.

11. A surface-coated steel strip as defined in claim 7, in which the Zn alloy is a Zn-Ni alloy of a single gamma-phase containing 10–20% by weight of Ni which is electroplated on the steel strip in a weight of 1–50 g/m$^2$.

12. A surface-coated steel strip as defined in claim 7, in which the Zn alloy applied to the steel strip is selected from the group consisting of:

Zn-Ni alloys containing 10–20% by weight of Ni,
Zn-Co alloys containing 0.5–10% by weight of Co,
Zn-Mo alloys containing 0.5–10% by weight of Mo,
Zn-Fe alloys containing 10–30% by weight of Fe,
Zn-Ni-Co alloys containing 5–20% by weight of Ni+Co,
Zn-Ni-Mo alloys containing 5–20% by weight of Ni+Mo, and
Zn-Ni-Fe alloys containing 5–30% by weight of Ni+Fe.

13. A surface-coated steel strip as defined in claim 12, in which an underlying layer of Zn or Zn-alloy plating or Al or Al-alloy plating is provided as a sacrificial corrosion resistant layer in a weight of 5–150 g/m$^2$, and the weight of the overlying Zn-alloy layer is not larger than 5 g/m$^2$.

14. A surface-coated steel strip as defined in claim 7, in which the passive-state layer comprises oxides, hydroxides, or sulfides of the alloying element or elements of said Zn-alloy.

15. A surface-coated steel strip as defined in claim 7, in which an organic resin layer is applied on top of the chromate layer.

16. A surface-coated steel strip having improved corrosion resistance as well as a good surface appearance, comprising a steel strip, a zinc alloy layer electroplated on the steel strip, a passive-state layer of oxides or hydroxides or sulfides from 0.005 to 1.0 μm thick applied on top of the plated zinc layer, and a chromate layer formed on the passive-state layer using a chromate solution of the reaction type.

17. A surface-coated steel strip as defined in claim 16, in which the thickness of the passive state layer is 0.01–0.5 μm.

18. A surface-coated steel strip as defined in claim 16, in which the Zn alloy is a Zn-Ni alloy of a single gamma-phase containing 10–20% by weight of Ni which is electroplated on the steel strip in a weight of 1–50 g/m$^2$.

19. A surface-coated steel strip as defined in claim 16, in which the Zn alloy applied to the steel strip is selected from the group consisting of:

Zn-Ni alloys containing 10–20% by weight of Ni,
Zn-Co alloys containing 0.5–10% by weight of Co,
Zn-Mo alloys containing 0.5–10% by weight of Mo,
Zn-Fe alloys containing 10–30% by weight of Fe,
Zn-Ni-Co alloys containing 5–20% by weight of Ni+Co,
Zn-Ni-Mo alloys containing 5–20% by weight of Ni+Mo, and
Zn-Ni-Fe alloys containing 5–30% by weight of Ni+Fe.

20. A surface-coated steel strip as defined in claim 19, in which an underlying layer of Zn plating or Al plating is provided as a sacrificial corrosion resistant layer in a weight of 5–150 g/m$^2$, and the weight of the overlying Zn-alloy layer is not larger than 5 g/m$^2$.

21. A surface-coated steel strip as defined in claim 16, in which the passive-state layer comprises oxides, hydroxides, or sulfides of the alloying element or elements of said Zn-alloy.

22. A surface-coated steel strip as defined in claim 16, in which an organic resin layer is applied on top of the chromate layer.

23. A surface-coated steel strip having improved corrosion resistance as well as a good surface appearance, comprising a steel strip, a zinc alloy layer plated on the steel strip, and a passive-state layer of oxides or hydroxides or sulfides from 0.005 to 1.0 μm thick which is applied on top of the plated zinc layer, in which the Zn alloy is a Zn-Ni alloy of a single gamma-phase containing 10–20% by weight of Ni which is electroplated on the steel strip in a weight of 1–50 g/m$^2$.

* * * * *